US008021242B1

(12) United States Patent
Tennison

(10) Patent No.: US 8,021,242 B1
(45) Date of Patent: Sep. 20, 2011

(54) GOLF SWING TRAINING DEVICE AND METHOD OF USE

(76) Inventor: James Darrin Tennison, San Tan Valley, AZ (US)

( * ) Notice: Subject to any disclaimer, the term of this patent is extended or adjusted under 35 U.S.C. 154(b) by 0 days.

(21) Appl. No.: 12/835,124

(22) Filed: Jul. 13, 2010

(51) Int. Cl.
*A63B 69/36* (2006.01)

(52) U.S. Cl. ..... 473/218; 473/272

(58) Field of Classification Search ..... 473/218, 473/257, 265, 270, 271, 272, 273, 278, 279
See application file for complete search history.

(56) References Cited

U.S. PATENT DOCUMENTS

| | | | |
|---|---|---|---|
| 1,208,995 | A | 12/1916 | Lyon |
| 3,041,075 | A | 6/1962 | Taylor |
| 3,868,116 | A | 2/1975 | Ford et al. |
| 4,322,084 | A | 3/1982 | Reece et al. |
| 4,384,718 | A | 5/1983 | Cachola |
| 4,538,815 | A | 9/1985 | Poirier |
| 4,563,010 | A | 1/1986 | McDorman et al. |
| 4,583,739 | A | 4/1986 | Kabbany |
| 4,647,048 | A | 3/1987 | Welch |
| 4,925,192 | A | 5/1990 | Forbes |
| 5,083,789 | A | 1/1992 | Hickson |
| 5,108,106 | A | 4/1992 | Cook |
| 5,203,453 | A | 4/1993 | Dirito |
| 5,246,234 | A | 9/1993 | Zambelli |
| 5,275,570 | A | 1/1994 | Hicks |
| 5,322,288 | A | 6/1994 | Amis |
| 5,335,915 | A | 8/1994 | Baudier |
| 5,350,177 | A | 9/1994 | Furbush, Jr. |
| 5,362,060 | A | 11/1994 | Hinson |
| 5,411,266 | A | 5/1995 | Guthry |
| 5,464,220 | A | 11/1995 | Hansen et al. |
| 5,730,659 | A | 3/1998 | Morita |
| D397,754 | S | 9/1998 | Nguyen |
| 5,827,128 | A | 10/1998 | Finch et al. |
| D402,730 | S | 12/1998 | Hicks |
| 5,944,613 | A | 8/1999 | Dubois |
| 5,984,801 | A | 11/1999 | Mason |
| 6,106,408 | A | 8/2000 | Roman |
| 6,669,575 | B1 | 12/2003 | Marlette |
| 6,723,003 | B1 | 4/2004 | Harrell |
| 6,726,576 | B1 | 4/2004 | Froggatte |
| 6,752,724 | B1 | 6/2004 | Schumacher |
| 6,949,029 | B1 | 9/2005 | Strande |
| 7,261,640 | B1 | 8/2007 | Baggott |
| D569,471 | S | 5/2008 | Wiersma |
| 2002/0098902 | A1 | 7/2002 | Rodriguez |
| 2006/0094519 | A1 | 5/2006 | Wynne |

(Continued)

FOREIGN PATENT DOCUMENTS

| | | | |
|---|---|---|---|
| CA | 2102687 | A1 | 8/1995 |

(Continued)

*Primary Examiner* — Nini Legesse
(74) *Attorney, Agent, or Firm* — The Law Office of Kevin C. Dixon, PLLC; Kevin C. Dixon

(57) ABSTRACT

The golf swing training device is used by golfers to gauge golf ball targeting and total body alignment. The golf swing training device comprises a device for teaching golfers seven golf swing fundamentals, including correct body alignment and ball targeting towards their desired target. The trainer has two tracks for alignment. These two tracks have graphical markings to assist the user in gauging the appropriate width of stance, ball position and shoulder alignment at address. The two tracks also form parallel targeting lines extending from the base of the trainer out to the desired target. First and second side pieces wrap around the user to form a trapezoidal frame. The side pieces are graphically marked to assist the user with hip, waist and leg alignment.

17 Claims, 1 Drawing Sheet

U.S. PATENT DOCUMENTS

2009/0124406 A1 5/2009 Alter

FOREIGN PATENT DOCUMENTS

| | | | |
|---|---|---|---|
| CA | 2303673 | A1 | 9/2001 |
| GB | 1293714 | A | 10/1972 |
| GB | 2087241 | A | 5/1982 |
| GB | 2100607 | A | 1/1983 |
| GB | 2245838 | A | 1/1992 |
| GB | 2291810 | A | 2/1996 |
| GB | 2305612 | A | 4/1997 |
| GB | 2310609 | A | 9/1997 |
| GB | 2349828 | A | 11/2000 |
| GB | 2351917 | A | 1/2001 |
| GB | 2435218 | A | 8/2007 |
| WO | 92/17248 | A1 | 10/1992 |
| WO | 93/04741 | A1 | 3/1993 |
| WO | 96/16707 | A1 | 6/1996 |

GOLF SWING TRAINING DEVICE AND METHOD OF USE

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF THE INVENTION

1. Field of the Invention

The present invention relates to golf training and practicing devices, and more particularly to devices designed to improve a golfer's stance, body alignment and swing path with respect to the position of the golf ball and target location.

2. Description of the Related Art

The game of golf is growing worldwide like no other sport. Participation and interest in the game is at an all time high. New and current golfers are serious about improving their golf game and are continually practicing to meet their goals. Golfers of all levels need help developing their golf swing fundamentals.

Golfers usually take golf lessons from club pros or golf instructors in an attempt to shorten their learning curve. However, it can be difficult for golf professionals to teach golfers the correct golf swing fundamentals by using verbal instruction.

There is an abundance of golf training aids available for use as a replacement of, or supplement to, professional instruction. Despite the availability of these golf training aids, many golf training aids have failed to come into widespread use due to a number of shortcomings. Most training aids only correctly address one or two of the several golf swing fundamentals needed to build a solid golf swing. Some training aids restrict the natural movement of a golfer when using the training aid. Others contradict known ways of teaching golfers the correct golf swing fundamentals.

A solution is needed to address one or more of these shortcomings in current golf training aids.

BRIEF SUMMARY OF THE INVENTION

The golf swing training device is a lightweight portable practicing device used for developing seven golf swing fundamentals. The training device represents two parallel tracks used as alignment guides to demonstrate proper body alignment and golf ball targeting. A first track is positioned at the feet of the golfer and has a directional arrow that points the golfer's body to the desired target. A second track has a pointed arrow which represents the golf ball targeting, golf ball flight path and club head takeaway path. The pointed arrow on the second track also indicates the proper placement of the golf ball.

Visual references are also provided on the golf swing training device. These references may be used to check the position and alignment of the golfer's stance at address, feet at address, hips at address, shoulders at address, the ball position in the golfer's stance and the club head takeaway path.

In use, the golfer places the golf swing training device on the ground or other suitable golfing surface (the "practice surface"), with the directional arrow of the first track pointing toward the target. The golfer then places a golf ball on the practice surface at the point of the targeting arrow. The golfer then proceeds to make visual checks with the visual references provided on the golf swing training device. The golfer then proceeds to strike the golf ball toward the intended target.

DETAILED DESCRIPTION OF THE INVENTION

Figure 1:
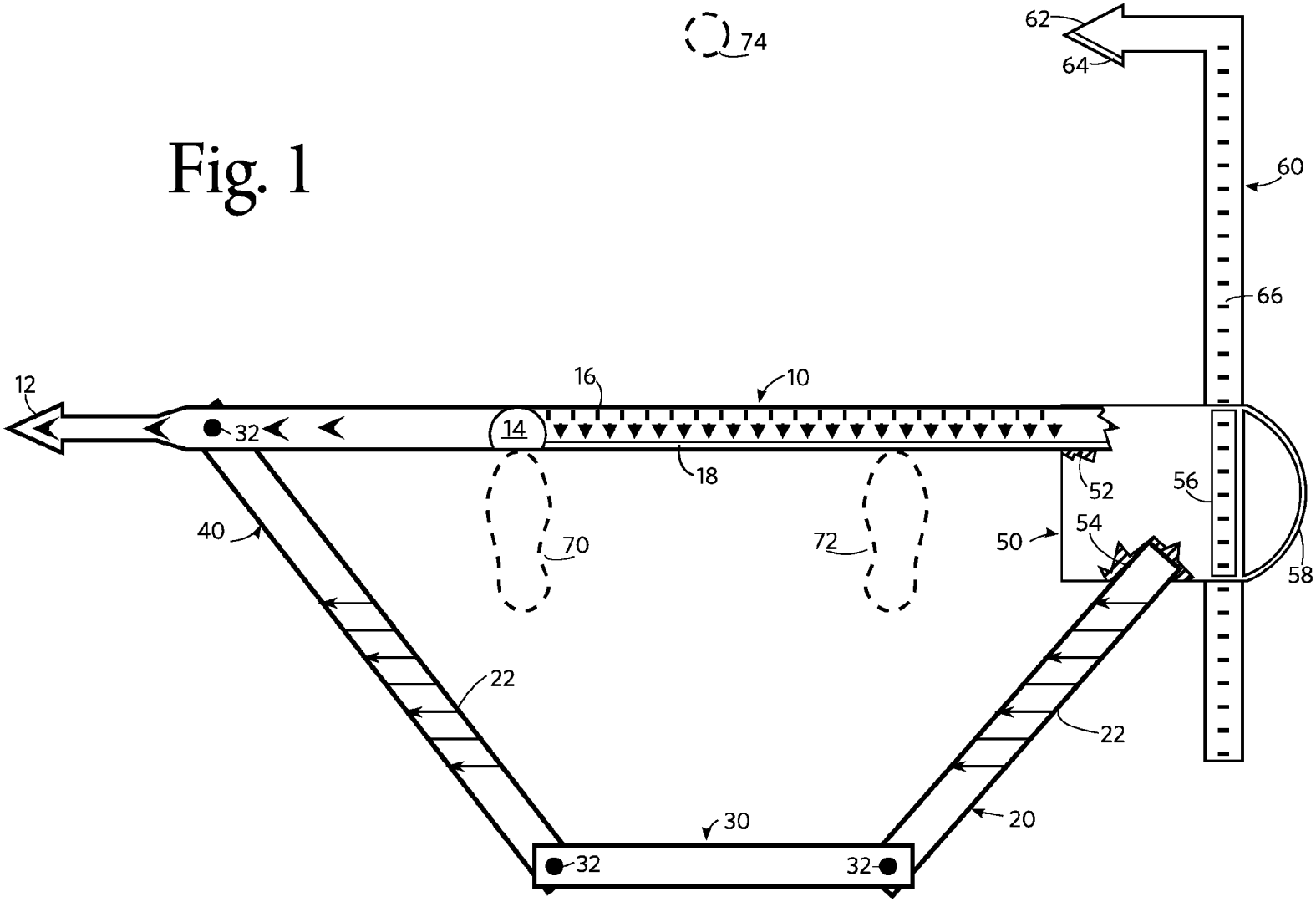
FIG. 1 depicts a fully assembled view of the golf swing training device.

The golf swing training device shown in FIG. 1 comprises six assembled parts. While this disclosure describes a device adapted to a right-handed golfer, it should be understood that any graphics or indicia on the device may be present on both sides, such that the device may be adapted to a left-handed golfer by switching which side of the device lays on a practice surface for golf. Any references in the disclosure to left and right hands or left and right feet are interchangeable for right-handed and left-handed golfers.

The device has a base piece 50. The base piece 50 has two pockets 52 and 54 for receiving a first track 10 and second piece 20. The base piece 50 further has a channel 56 allowing a second track 60 to pass through the base piece 50. Attached to the base piece 50 is a handle 58 for carrying the device.

Extending from pocket 52 of the base piece 50 is a first track 10. The first track 10 has on the end opposite of the base piece 50 an elongated targeting arrow 12. The first track 10 has a front foot position indicator 14, with stance width indicia 16. The stance width indicia 16 has graphical representations showing a distance from the front foot position indicator 14, with a total range of between 24 inches (60.96 cm) and 36 inches (91.44 cm). Along one side of the first track 10 is a shoulder alignment graphic 18.

Extending from pocket 54 of the base piece 50 is a first side piece 20. The side piece attaches to a rear piece 30. The rear piece 30 then attaches to a second side piece 40. The second side piece 40 is then attached to the first track 10. Side pieces 20 and 40 are attached to rear piece 30 by means of a plastic or metal swiveling pin 32. Side piece 40 is likewise attached to first track 10 by another swiveling pin 32. Rear piece 30 is substantially parallel to the first track 10, the first track 10, rear piece 30 and side pieces 20 and 40 forming a frame of essentially trapezoidal shape.

Extending from channel 56 of the base piece 50 is a second track 60. The second track 60 extends substantially perpendicularly from the first track 10. The distance of extension may be adjusted by sliding the second track 60 through the channel 56. Along the body of the second track 60 are track extension indicia 66. At one end of the second track 60 is a targeting arrow 62 which is oriented parallel to the first track 10. Along the bottom of the targeting arrow 62 is a club takeaway path indicator 64.

In use, a golfer first places the golf swing training device on the ground or other surface suitable for practicing golf ("the practice surface"). The device is then oriented such that the targeting arrow 62 is pointed toward the desired target for the swing. The golfer then steps inside the frame of the device, and aligns the forward foot 70 with the front foot position indicator 14. For a right-handed golfer, the left foot is the forward foot 70. The golfer then takes a comfortable stance, approximately a shoulder width apart. The stance width indicia 16 may then be used to measure the width of the golfer's stance, with the measurement beginning at zero at the inside of the forward foot 70 and increasing along the stance width indicia 16. The number displayed on the stance width indicia 16 directly above the inner portion of the golfer's rear foot 72 is the total distance between the forward foot 70 and the rear foot 72.

The golfer next checks the position of the golf ball 74 in their stance using stance width indicia 16. When golfing with short irons, the golf ball 74 should be placed on the practice surface positioned directly above the mid-point of the golfer's stance. When using longer irons and woods, the golf ball 74 should be placed slightly forward of the mid-point of the golfer's stance. To assure that the golf ball 74 is positioned correctly at address, the golfer should place the golf ball 74 in front of the targeting arrow 62, then stand at address. The front foot 70 is aligned with the front foot position indicator 14. Using the stance width indicia 16, the user may see the distance from the front foot 70 to the golf ball 74 in the golfer's stance.

The golfer next checks to ensure that their shoulders are aligned parallel to the first track 10. To complete this check, the golfer rests a golf club across their chest. While holding the golf club in place, the golfer looks down at the shoulder alignment graphic 18. The golfer then adjusts their shoulder alignment until the golf club is parallel with the shoulder alignment graphic 18.

The golfer next checks hip and waist alignment. In a manner similar to checking shoulder alignment, the golfer rests a golf club across their hips or waist. While holding the golf club in place, the golfer looks down at hip alignment guides 22, which are parallel to the first track 10. The golfer then adjusts their hip alignment until the golf club is parallel to the hip alignment guides 22.

The golfer next checks leg alignment in a manner similar to that of checking shoulder or hip alignment. While holding a golf club across their legs, the golfer adjusts their leg alignment until the golf club is parallel to the first track 10 or the hip alignment guides 22.

The golfer next checks the distance between the club head and the golfer. To do this, the golfer first steps into the device at address. The golfer then takes one hand and spreads all fingers open. The golfer then touches the lower part of their stomach with their little finger. With the hand still spread open, the golfer places the head of the golf club on the ground and positions the handle of the golf club so that it touches the golfer's thumb. While maintaining this position of the golf club, the golfer then proceeds to take their normal grip on the handle of the golf club. The golfer may then adjust the extension of the second track 60 until the targeting arrow 62 is aligned with the head of the golf club. The distance between the head of the golf club and the golfer's body is displayed on the track extension indicia 66. It may be necessary to repeat the steps of checking the position of the golf ball 74 and the various alignment checks if the second track 60 needed adjustment.

After the golfer has completed the visual checks referenced on the device, the golfer then proceeds to strike the golf ball 74. While raising the club head away from the golf ball 74, the club head will pass directly over the targeting arrow 62, taking a slight inside path. During the takeaway, the club head will glide directly over the club takeaway path indicator 64.

After a first use, the golfer may record the golfer's stance width and extension of the second track 60 to expedite future use with a given golf club.

I claim:

1. A golf swing training device comprising:

(A) a first track with a front foot position indicator and stance width indicia;

(B) a second track extending substantially perpendicularly to the first track, the second track having a golf ball targeting member situated to be parallel to the first track; and (C) a first side piece and a second side piece designed to wrap around a user of the device, wherein:

(i) the first side piece and the second side piece are placed on opposite sides of a user when a front foot of the user is placed at the front foot position indicator, (ii) the first side piece and the second side piece each have visual guides for aligning the user's hips to be parallel with the first track, and (iii) the visual guides on the first side piece are substantially collinear with the visual guides on the second side piece and the hips of the user.

2. The device of claim 1 wherein the first track has a targeting member for orienting the device toward a golf target.

3. The device of claim 1 wherein the second track has track extension indicia.

4. The device of claim 1 wherein the first and second tracks and the first side piece connect to a base piece.

5. The device of claim 4 wherein the first and second tracks and the first and second side pieces may be detached and housed within the base piece.

6. The device of claim 1 wherein:

(A) the first track is equipped with a first light generating device oriented substantially perpendicularly from the first track;

(B) the golf ball targeting member is equipped with a second light generating device oriented substantially parallel to the first track; and (C) the light from the first light generating device and the light from the second light generating device locate a position to place a golf ball.

7. A golf swing training device comprising:

(A) a first track with a front foot position indicator and stance width indicia, the first track having a targeting member for orienting the device toward a golf target;

(B) a second track extending substantially perpendicularly to the first track, the second track having a golf ball targeting member situated to be parallel to the first track and track extension indicia; and (C) a first side piece and a second side piece designed to wrap around a user of the device, wherein:

(i) the first side piece and the second side piece are placed on opposite sides of a user when a front foot of the user is placed at the front foot position indicator, (ii) the first side piece and the second side piece each have visual guides for aligning the user's hips to be parallel with the first track, and (iii) the visual guides on the first side piece are substantially collinear with the visual guides on the second side piece and the hips of the user;

(D) wherein the first and second tracks and the first side piece connect to a base piece.

8. The device of claim 7 wherein the first and second tracks and the first and second side pieces may be detached and housed within the base piece.

9. The device of claim 7 wherein:

(A) the first track is equipped with a first light generating device oriented substantially perpendicularly from the first track;

(B) the golf ball targeting member is equipped with a second light generating device oriented substantially parallel to the first track; and (C) the light from the first light generating device and the light from the second light generating device locate a position to place a golf ball.

10. A method of practicing a golf swing comprising:

(A) providing a golf swing training device, the device comprising (i) a first track with a front foot position indicator and stance width indicia, (ii) a second track extending substantially perpendicularly to the first track, the second track having a golf ball targeting member situated to be parallel to the first track, and (iii) a first side piece and a second side piece designed to wrap around a user of the device, the side pieces having visual guides for aligning the user's hips, the alignment guides being parallel to the first track;

(B) placing the golf swing training device on a golf practicing surface;

(C) placing a golf ball in front of the golf ball targeting member;

(D) orienting the golf ball targeting member toward a desired target;

(E) gauging a stance width using the front foot position indicator and stance width indicia;

(F) positioning the golf ball in approximately the center of the stance width;

(G) aligning the user's shoulders to be parallel to the first track;

(H) aligning the user's hips and waist to be parallel to the alignment guides on the first and second side pieces;

(I) aligning the user's legs to be parallel to either the first track or the alignment guides on the first and second side pieces;

(J) checking the distance between the user and the head of a golf club by resting the head of the golf club on the ground and placing the handle of the golf club so that it is one hand span away from the lower part of the user's stomach;

(K) setting the golf ball targeting member to the distance between the user and the head of the golf club;

(L) raising the head of the golf club over the golf ball targeting member; and (M) swinging the head of the golf club over the golf ball targeting member and striking the golf ball.

11. The method of claim 10 wherein the first track has a targeting member for orienting the device toward a golf target.

12. The method of claim 10 wherein the second track has track extension indicia.

13. The method of claim 10 wherein the first and second tracks and the first side piece connect to a base piece.

14. The method of claim 13 wherein the first and second tracks and the first and second side pieces may be detached and housed within the base piece.

15. The device of claim 10 wherein:

(A) the first track is equipped with a first light generating device oriented substantially perpendicularly from the first track;

(B) the golf ball targeting member is equipped with a second light generating device oriented substantially parallel to the first track; and (C) the light from the first light generating device and the light from the second light generating device locate a position to place a golf ball.

16. The device of claim 10 wherein:

(A) the first side piece and the second side piece are placed on opposite sides of a user when a front foot is placed at the front foot position indicator; and (B) the visual guides on the first side piece are substantially collinear with the visual guides on the second side piece and the hips of the user.

17. The device of claim 16 wherein:

(A) the first track is equipped with a first light generating device oriented substantially perpendicularly from the first track;

(B) the golf ball targeting member is equipped with a second light generating device oriented substantially parallel to the first track; and (C) the light from the first light generating device and the light from the second light generating device locate a position to place a golf ball.

* * * * *